US010533737B1

(12) United States Patent
Dos Reis

(10) Patent No.: US 10,533,737 B1
(45) Date of Patent: Jan. 14, 2020

(54) ARTICLE WITH ADJUSTABLE SHELF WITH LIGHTING SYSTEM

(71) Applicant: Domingos Dos Reis, Mineola, NY (US)

(72) Inventor: Domingos Dos Reis, Mineola, NY (US)

( * ) Notice: Subject to any disclaimer, the term of this patent is extended or adjusted under 35 U.S.C. 154(b) by 0 days.

(21) Appl. No.: 16/288,758

(22) Filed: Feb. 28, 2019

(51) Int. Cl.

| | |
|---|---|
| ***H01R 13/24*** | (2006.01) |
| ***F21V 23/06*** | (2006.01) |
| ***F21S 4/00*** | (2016.01) |
| ***F21V 33/00*** | (2006.01) |
| ***H01R 33/94*** | (2006.01) |
| ***A47B 63/00*** | (2006.01) |
| ***H01R 33/88*** | (2006.01) |
| *F21W 131/301* | (2006.01) |
| *F21Y 115/10* | (2016.01) |
| *A47F 11/10* | (2006.01) |
| *A47F 5/00* | (2006.01) |

(52) U.S. Cl.
CPC ..... *F21V 23/06* (2013.01); *A47B 63/00* (2013.01); *F21S 4/00* (2013.01); *F21V 33/0012* (2013.01); *H01R 13/2407* (2013.01); *H01R 33/88* (2013.01); *H01R 33/94* (2013.01); *A47B 2220/0077* (2013.01); *A47F 5/0043* (2013.01); *A47F 11/10* (2013.01); *F21W 2131/301* (2013.01); *F21Y 2115/10* (2016.08); *H01R 13/2421* (2013.01)

(58) Field of Classification Search
CPC ..... A47F 5/043; A47F 11/10; H01R 13/2421
See application file for complete search history.

(56) References Cited

U.S. PATENT DOCUMENTS

| | | | | |
|---|---|---|---|---|
| 6,042,244 | A * | 3/2000 | Witkoski | A47F 5/0043 362/125 |
| 2008/0043456 | A1* | 2/2008 | Bernardini | A47B 57/42 362/94 |
| 2011/0273867 | A1* | 11/2011 | Horst | A47B 96/021 362/133 |
| 2013/0299439 | A1* | 11/2013 | Sid | A47F 5/0018 211/134 |
| 2014/0227893 | A1* | 8/2014 | Howard | A47B 97/00 439/121 |
| 2015/0201762 | A1* | 7/2015 | Walter | F21V 21/35 211/187 |

* cited by examiner

*Primary Examiner* — Tho D Ta
(74) *Attorney, Agent, or Firm* — Leason Ellis LLP

(57) ABSTRACT

An article, such as a piece of furniture, includes one or more adjustable shelves each of which includes a lighting system which is connected to a power source in such a way that each shelf can be freely adjusted within a frame of the article so as to alter the location of the shelf and/or the spacing between shelves.

19 Claims, 3 Drawing Sheets

ARTICLE WITH ADJUSTABLE SHELF WITH LIGHTING SYSTEM

TECHNICAL FIELD

The present invention is directed to an article, such as a piece of furniture, that includes one or more adjustable shelves each of which includes a lighting system which is connected to a power source in such a way that each shelf can be freely adjusted within a frame of the article so as to alter the location of the shelf and/or the spacing between shelves.

BACKGROUND

There are many types of articles, such as pieces of furniture, that include at least one shelf. For example, these types of articles of furniture can be in the form of a bookshelf, a side table, an end table, a curio cabinet, a credenza, etc. It is also very popular and desirable to add lighting to such article of furniture in order to illuminate the objects contained within the article of furniture. Traditionally, the lighting system is integrally incorporated into one of the fixed parts of the article of furniture and more particularly, the lighting system is incorporated into the outer frame of the article of furniture. The shelves are standard shelves that are coupled to the frame to permit, in some cases, adjustability. However, due the need for adjusting the shelves, the lighting system is not incorporated into the shelves since the lighting system having wiring that must be connected to the power source.

SUMMARY

In accordance with one embodiment of the present invention, an article of furniture comprises a frame having a first side wall and an opposing second side wall. The first and second side walls have mounting holes formed along inner surfaces thereof. The article includes at least one first electrical connector that is coupled to the first side wall. The at least one first electrical connector having a plurality of conductive sockets that are open along an inner surface of the first side wall of the frame. The at least one first electrical connector being configured for electrification by being connected to a power cable for connection to a power source. The plurality of conductive sockets define different vertical mounting positions within the frame.

The article also includes at least one conductive shelf pin that is inserted into one selected conductive socket and a plurality of shelf mounting pins for insertion into select mounting holes. The at least one shelf that is coupled to the frame in an adjustable manner and each shelf has at least one contact pin assembly along one end of the shelf. Each contact pin assembly includes a biased conductive contact pin that protrudes downward from a bottom surface of the shelf and is for placement in intimate contact with one conductive shelf pin.

A lighting system is associated within that at least one shelf and is conductively connected to the biased contact pin such that the shelf can be freely adjusted within the frame by placing the shelf on at least one conductive shelf pin and select shelf mounting pins.

BRIEF DESCRIPTION OF THE DRAWING FIGURES

DETAILED DESCRIPTION OF CERTAIN EMBODIMENTS

Figure 1:
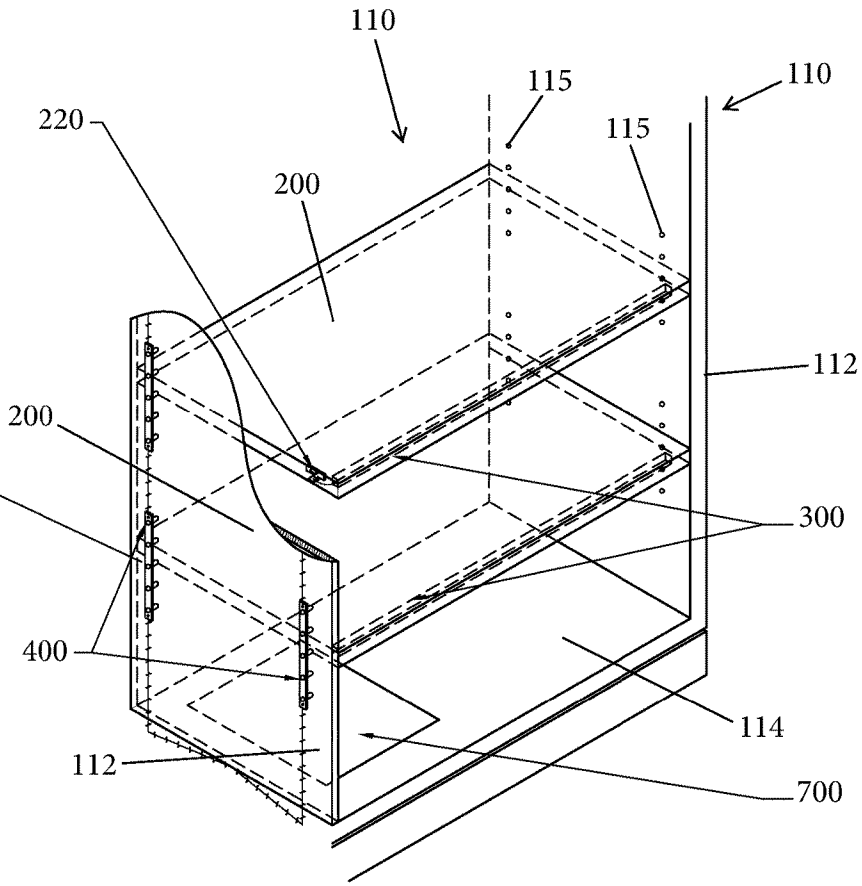
FIG. 1 is a partial perspective view of an article of furniture with one or more and preferably a plurality of adjustable shelves in which each shelf has a lighting system.

FIGS. 1-4 illustrates an article of furniture 100 which can come in any number of different forms, including but not limited to a bookcase, a side table, an end table, a curio cabinet, a credenza or any other article of furniture that has the features described herein. The article of furniture 100 in FIG. 1 is a bookcase or similar piece of furniture. As described herein, the article of furniture 100 includes one or more adjustable shelves 200.

The article of furniture 100 includes a frame 110 and in the case in which the article 100 is a bookcase, the frame 110 has a pair of side walls 112, a bottom wall 114, a top wall (not shown) and also, typically, a rear wall (not shown). The side walls 112 are opposite one another and are typically oriented perpendicular to the bottom wall 114 and the top wall. Along the inner surfaces of each of the side walls 112 are a plurality of holes 115 that are formed in a linear manner. As shown, each side wall 112 can include two sets of holes 115 that extend vertically along the side wall 112, with one set of holes 115 being spaced from the other set of holes 115. Within each set of holes 115, the holes 115 can be arranged in subsets with one subset of holes 115 intended for placement of the shelf 200 along the side walls 112 in one region, while the other subset of holes 115 is for placement of the shelf 200 in another region, thereby allowing the distance between the shelves 200 to be adjusted and to allow for placement of the shelves 200 at desired locations.

In accordance with the present invention, the frame 110 and the shelves 200 are constructed to permit each shelf to include a lighting system 300 but at the same time allow for adjustment and repositioning of the shelves 200 without any rewiring, wire repositioning, etc.

Figure 3:
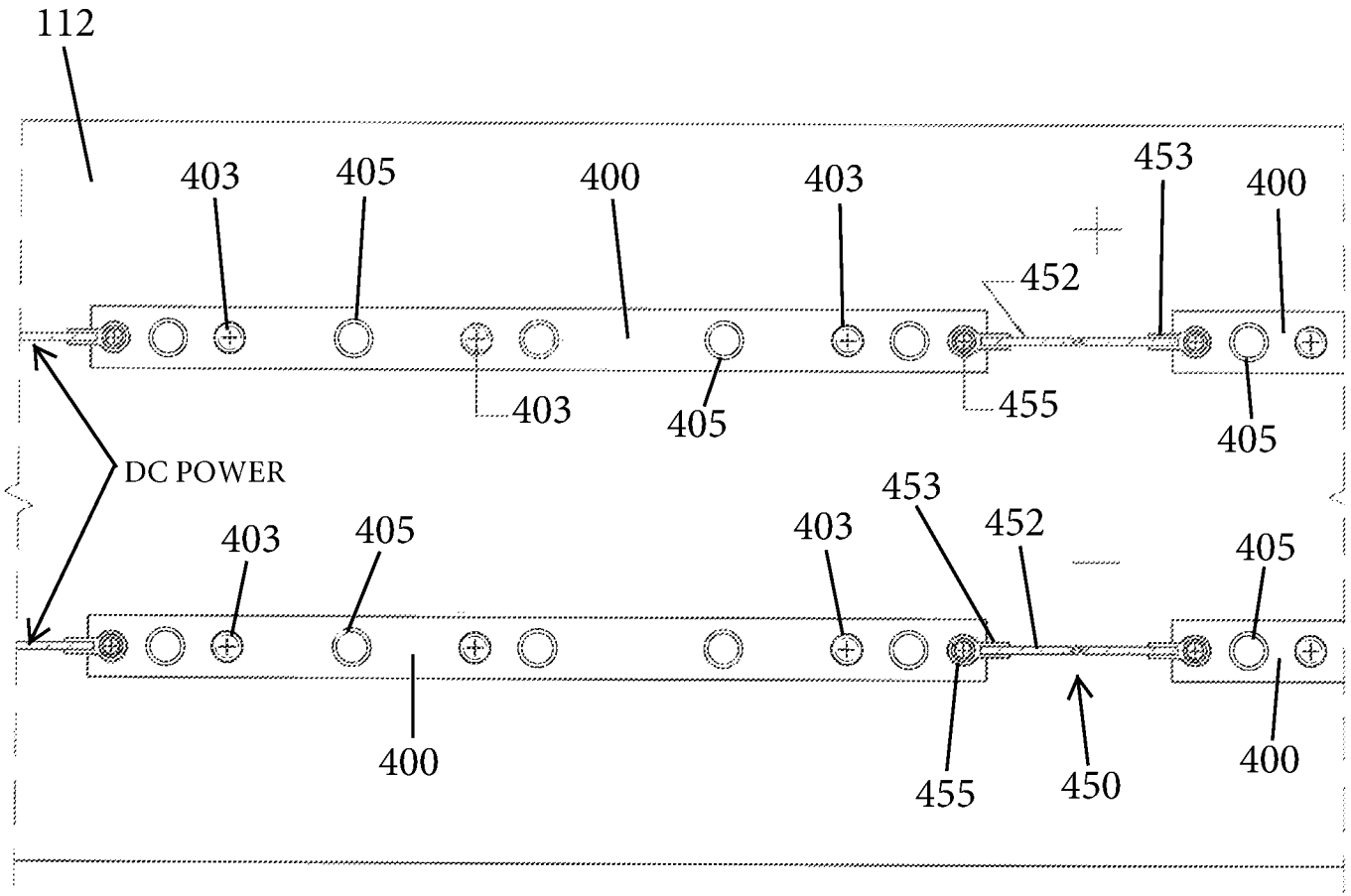
FIG. 3 is an elevation view of a pair of electrical connectors that are intended to be coupled to a frame portion of the article of manufacture.

As shown in FIGS. 1 and 3, one side wall 112 includes one or more and preferably a plurality of electrical connectors 400. Similar to holes 115, each side wall 112 can include a pair of electrical connectors 400 that are spaced apart from one another. The electrical connectors 400 can be oriented vertically along the side wall 112 and are spaced apart from one another. The electrical connector 400 comprises a rail that includes a plurality of holes 402 for receiving fasteners 403 to attach the electrical connector 400 to the side wall 112. The electrical connector 400 also includes one or more and preferably a plurality of sockets 405 that are spaced apart along the length of the electrical connector 400. The sockets 405 can come in any number of different shapes, such as cylinders, as shown. In the illustrated embodiment, there are five (5) sockets 405. The holes 402 are interspersed between the sockets 405.

As described herein, when a pair of connectors 400 are used and connected to a single lighting system 300, one of the connectors 400 is connected to a positive (hot) terminal of the power source and the other connector 400 is connected to ground. Thus, while the pair of connectors 400 are shown as being located along the same end wall of the frame, the connectors could be along opposing end walls of the frame.

The electrical connectors 400 can be considered to be essentially or similar to a bus bar type arrangement in that the electrical connectors 400 carry current for powering the lighting system 300 (and provide ground). As described herein, one of the connectors 400 and associated sockets 405 thereof can be considered to be "live" (electrical current flows therethrough), while the other connector 400 and associated sockets 405 can be considered to be an electrical ground.

As shown in the figures, a plurality of individual electrical connector 400 can be connected to one another in series to form a single connected structure that extends vertically along the side wall of the frame. Two electrical connectors 400 can be connected with an electrical coupling member 450. The electrical connectors 400 can be arranged and connected in an end-to-end relationship. The coupling members 450 thus connect one end of one electrical connector 400 to one end of another electrical connector 400. The coupling members 450 thus are also located in series with the electrical connectors 400 to form an electrified chain that is mounted along the side wall 112.

The coupling member 450 can comprise a metal wire 452 with connectors 453 at the end that are connected to the ends of the individual electrical connector 400 to electrically connect the two electrical connectors 400. Fasteners 455 can be used to connect the connectors (e.g., eyelets) at the ends of the wire 452.

The electrical connectors 400 are mounted such that the sockets 405 pass through select holes 115 in the side wall 112 and are open and accessible along the inner surface of the side wall 112. This orientation is shown in the cross-sectional view of FIG. 2. The electrical connectors 400 and the coupling members 450 can be mounted along the outer surface of the side walls 112 and then covered with a suitable cover material. The lengths of the sockets 405 are thus selected in view of the thickness of the side wall 112 to allow for the sockets 405 to extend through the side wall 112 and be accessible along the inner surface of the side wall 112.

Fasteners 403 can be in the form of screws, such as #8 pan head screws and fasteners 455 can be in the form of #6 pan head screws and the metal wire 452 can be #16 gauge wire. However, it will be appreciated that the fasteners 403 and 455 can be selected from any number of suitable fasteners.

When installed, the conductive sockets 405 extend along one side wall 112 and are paired with and are opposite holes 105 formed in the other side wall 105 (and optionally also in the one side wall 112 when the conductive sockets 405 are only positioned in one corner of the shelf).

Figure 4:
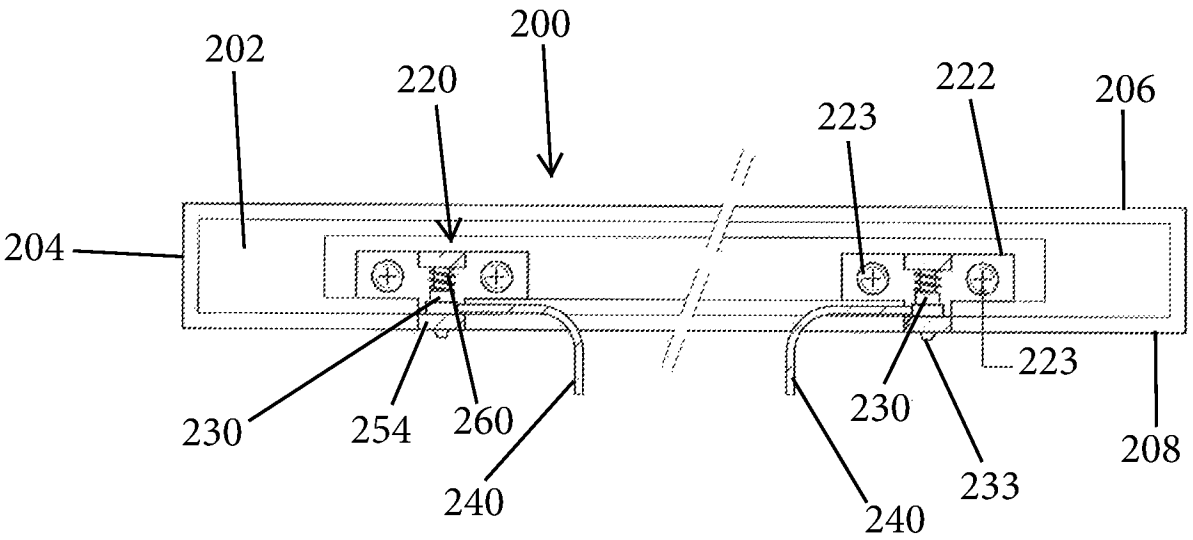
FIG. 4 is an end elevation view of a shelf.

FIG. 4 is an end elevation view of one shelf 200. The shelf 200 is formed of a base (shelf body) 210 that can come in any number of different shapes and sizes so long as they are complementary to the shape of the frame 110 since each shelf 200 is received and held within the frame 110. The shelf 200 can therefore have a rectangular shape, as shown, with two opposing ends 202 and opposing sides 204, along with a top surface 206 and an opposing bottom surface 208. One of the ends 202 includes one or more end connectors 220 that are configured to be electrically connected to a corresponding electrical connector 400 associated with one side wall 112. Preferably, one end of the shelf 200 includes a pair of end connectors 220, with one of the connectors 220 acts as a positive (hot) connector for supply electricity to the lighting system, while the other of the connectors 220 acts as a negative connector (a ground). Alternatively, one connector 220 can be along one end wall and the other connector 220 can be along the other end of the shelf so long as the pair of connectors 220 is associated with one lighting system 300 and thus, one connector 220 acts as a live connection and the other acts as a ground.

It will be appreciated that when one connector 220 is used as the "live" connector for supplying power to the lighting system 300, an alternative manner of grounding the lighting system can be used instead of using a second connector 220. However, the illustrated and preferred arrangement is to have a pair of connectors 220 at one end of the shelf 200 for providing electrical current to the lighting system 300 and for grounding said lighting system as described herein.

The end connector 220 includes a plate (substrate or base) 222 that is attached to the end 202 using conventional techniques, such as fasteners 223 (e.g., #8 pan head screws).

The lighting system 300 is incorporated into the shelf 200 and, as shown in FIG. 1, the lighting system 300 can be disposed at or near the front edge along the underside (bottom surface 208) of the shelf 200. The shelf 200 has a hollow portion (space) 201 (FIG. 2) formed at one end thereof and in which a portion (assembly) of the connector 220 is received. More specifically, the connector 220 includes a biased contact pin 230 that is electrically connected to a wire 240 that is connected at its opposite end to the lighting system 300. Thus, electricity runs through one conductive contact pin 230 to the respective wire 240 to the lighting system 300 for powering the light source (e.g., LEDs) of the lighting system 300. Within the hollow portion 201 a contact pin support (stand) 250 can be provided and includes a top wall 252 and an opposing bottom wall 254 with a vertical wall extending therebetween and connecting the top and bottom walls. The upper end 231 of the contact pin 230 faces and can even pass through a hole in the top wall 252 and the lower end 233 of the contact pin 231 can pass through a hole in the bottom wall 254. A biasing element, such as a spring 260, is disposed between an enlarged section (shoulder) 237 of the contact pin 230 and the underside of the top wall 252 so as to apply a biasing force to the contact pin 230 in a downward direction (i.e., a direction away from the top wall 252). This biasing action ensures that the contact pin 230 is always in conductive contact.

The contact pin 230 can have a stepped construction, including the shoulder 237; however, only the bottom tip (lower end 233) of the pin 230 can pass through the hole in the bottom wall 254 (the lower body of the pin from which the bottom tip extends is larger than the hole and thus contact and seats against the bottom wall 254 in the maximum down position of the contact pin 230). In this position, the bottom tip 233 of the pin 230 extends below the bottom surface of the shelf 200.

The contact pin 230 is formed of a conductive material, such as a metal, and is electrically connected to the wire 240 which leads to the lighting system 300. The connection of the wire 240 to the contact pin 230 is one which permits movement of the wire 240 in response to the movement of the contact pin 230. For example, the wire 240 can be soldered to the lower body of the contact pin 230. As described herein, the wire 240 either acts as a live wire carrying electrical current to the lighting system 300 or acts as a ground wire.

Each corner of one end wall of the shelf 200 can include one contact pin 230. As shown, the contact pins 230 are vertically oriented relative to the shelf 200 and the side wall 112.

The lighting system 300 can include any number of different lighting sources, including but not limited to an LED source that can be in the form of a string of LEDs. The lighting system 300 is oriented so that it illuminates downward and can illuminate objects that are disposed on the below shelf. The underside of the shelf 200 can include more than one lighting system 300 (e.g., string of LEDs) and they can be spaced apart from one another along the underside.

The wires 240 lead to the lighting system 300 which is fixedly attached to the shelf 200 (e.g., the underside of the shelf 200) and as described herein, one wire can be a live wire and the other can be a ground wire (FIG. 4).

Insertable shelf pins 270 are provided and are used to support the shelves 200. The shelf pins 270 are configured to be inserted into the sockets 405 for supporting the shelf 200 by having the shelf 200 placed on top of shelf pins 270 that are positioned in the four corners of the shelf 200 to support the shelf 200. The pin 270 is configured to be received within the socket 405 and therefore, has a complementary shape. When the socket 405 has a cylindrical shape, the pin 270 can have an end portion that has a cylindrical shape that can be received within the socket 405. Another end of the pin 270 can have a different shape, such as including a flat portion on which the bottom of the shelf 200 rests. For example, the inner end of the pin 270 can have a flat surface 275 on which the bottom tip 233 of the pin 230 seats and therefore, since the shelf pin 270 is formed of a conductive material and the contact pin 230 is formed of a conductive material, an electrical connection can be formed between the shelf pin 270 and the contact pin 230 to allow electrical current flowing through the connector 400 to be delivered to the contact pin 230 through the socket 405 and then ultimately to the lighting system 300. It will therefore, be appreciated that since the sockets 405 are formed of a conductive material and therefore, when the shelf pin 270 is inserted into the socket 405 and the contact pin 230 seats against the shelf pin 270, at least one contact pin 230 is electrically connected to the socket 405 and therefore, current that is supplied to the socket 405 can be delivered to the corresponding contact pin 230 and ultimately to the lighting system 300 for lighting thereof.

In other words, the contact pin 230 that is part of the live connector 220 (that carries current) is connected to the positive terminal of the power source and carries electrical current to the lighting system 300, while the other contact pin 230 that is connected to the ground connector 220 acts as a ground for the lighting system 300.

For those holes 115 that do not receive and contain sockets 405, the shelf pins 270 inserted therein do not necessarily have to be formed of a conductive material; however, in order to have all the shelf pins 270 be uniform and provide support for shelf 200, all are typically formed of a conductive material (metal).

The spring biased nature of the contact pins 230 ensures that a conductive contact is always maintained between the contact pin 230 and the shelf pins 270 and therefore, any tolerances due to shelf positioning within the frame are accounted for since the contact pin 230 is biased into conductive contact with the shelf pin 270 which ensures an electrical connection is always maintained and there are no electrical interruptions with the lighting system 300. Thus, even if one corner is slightly offset relative to the others or the shelf pin 270 is mispositioned or if there are manufacturing tolerances with the shelf pin 270, the biased nature of the contact pin 230 ensures that the electrical connection is maintained. The contact pins 230 are sized and supported such that even if the contact pins 230 are fully pressed into the shelf 200, at least a portion of the tip 233 is located below the bottom surface of the shelf 200 and therefore, can make contact with the conductive shelf pin 270.

In other words, the spring biased nature of the contact pins 230 accounts for the shelf not lying perfectly flat on the shelf pins 270 and ensures that the electrical connection (via the live contact pin 230) and the ground connection (via the ground contact pin 230) are achieved and maintained since the contact pins 230 will spring downward into contact with the shelf pins 270 even if a particular corner of the shelf is raised relative to (spaced from) the shelf pin 270.

The present invention allows for adjustment of the shelf 200 since the shelf pins 270 can be readily removed and inserted into other conductive sockets 405 to move the shelf position within the frame 110. Once the shelf pins 270 are inserted into the new set of sockets 405 and holes 115, the shelf 200 is positioned on top of the shelf pins 270 resulting in the biased contact pins 230 making contact with the conductive shelf pins 270, thereby powering the lighting system 300 once the conductive connection is made.

Once power is supplied to the live (positive) electrical connector(s) 400, the socket 405 coupled thereto is electrified at a low voltage and then the insertion of the shelf pin 270 into the socket 405 and placement of the shelf 200 on the shelf pin 270 establishes an electrical connection, via contact pin 230, with the lighting system 300 associated with the shelf 200.

It will also be appreciated that the lighting system 300 itself can have an on/off switch for controllably turning the lighting system 300 on or off. This could be in the form of a push button switch that is integrated into the underside of the shelf 200.

Figure 2:
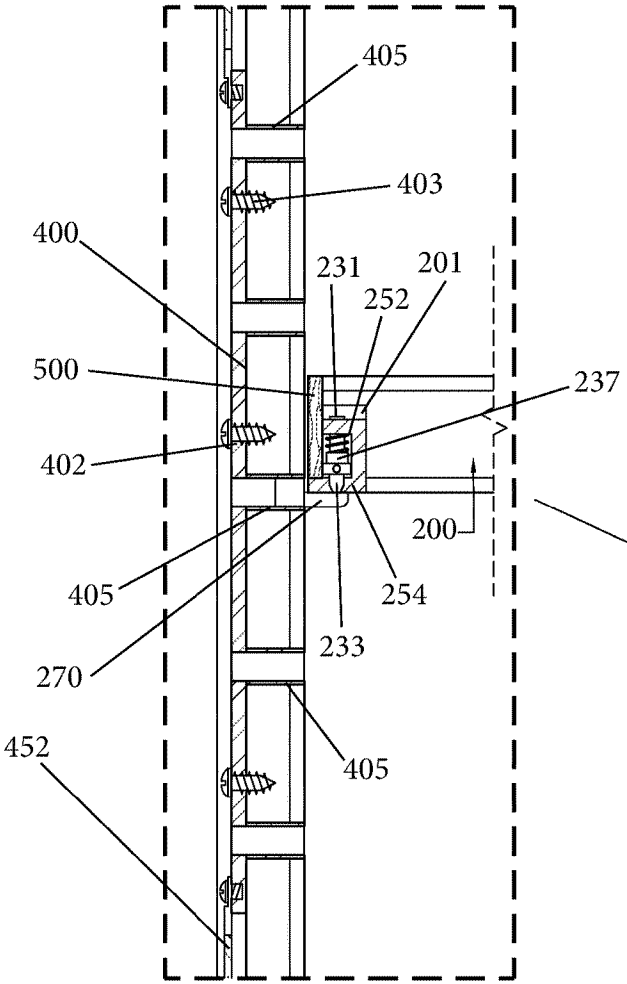
FIG. 2 is a side cross-sectional view of a portion of the article of furniture.

Finishing edge 500 can be provided along the end wall 202 of the shelf 200 to cover the contact pin assembly that is contained within the hollow portion 201. The finishing edge is shown in FIG. 2 and is configured to extend across a portion or the entire end of the shelf 200 so as to cover the contact pin assembly. The contact pin support (stand) 250 can be formed such that the top wall 252 is narrower than the opposing bottom wall 254 and therefore an outer edge of the bottom wall 254 extends outwardly beyond the outer edge of the top wall 252 and this section represents a ledge on which the bottom edge of the finishing edge 500 can be disposed. The top portion of the finishing edge 500 seats flush against the outer edge of the top wall 252. The finishing edge 500 can be attached to the contact pin support 250 using traditional techniques, such as using an adhesive or other type of bonding agent, so as to preferably leave a smooth uniform outer end surface of the shelf 200.

The power source is typically an electrical outlet in which a power cord (cable) is inserted so as to electrically connect the power source to the electrical connectors 400. As shown in FIG. 3, one of the cables (wires) 452 can be connected to a DC power source and in particular, the cables 452 can lead to a common connector (driver as set forth below) that has a single power cable for insertion into an electrical outlet of a home, etc. Other electronics can be provided to deliver the proper power supply to the lighting systems 300.

As will be appreciated in the lighting system 300 can have a positive (hot) wire and a negative (ground) wire. In FIG. 4, one of the wires 240 is a positive (hot) wire connected to the lighting system 300 for providing power thereto and the other of the wires 240 is connected to the lighting system 300 and acts as a ground. As discussed herein, there are two connectors 220 that are at the end of the shelf 200 with one of them serving to provide electricity to the lighting system (and thus can be considered to be a positive or hot connector) while the other connector acts as a ground. As is known, a ground (e.g., ground wire) is an additional path for electrical current to return safely to the ground without danger to anyone in the event of a short circuit.

In addition, the bottom wall of the frame 110 can include an access hatch 700 to also access to certain electronics, such as the lighting drivers. For example, most households use 120-277V AC electricity, but LEDs operate on low voltage DC electricity. Thus, the driver changes the higher voltage AC current into the lower voltage DC current to match what the LEI) lights need to operate. These drivers can thus be located in a concealed space below the bottom wall and can be accessed via the hatch 700. Thus, one of the connectors 220 is connected to the positive terminal of the driver and the other connector 220 is connected to the negative terminal of the driver.

Notably, the figures and examples above are not meant to limit the scope of the present invention to a single embodiment, as other embodiments are possible by way of interchange of some or all of the described or illustrated elements. Moreover, where certain elements of the present invention can be partially or fully implemented using known components, only those portions of such known components that are necessary for an understanding of the present invention are described, and detailed descriptions of other portions of such known components are omitted so as not to obscure the invention. In the present specification, an embodiment showing a singular component should not necessarily be limited to other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration.

The foregoing description of the specific embodiments will so fully reveal the general nature of the invention that others can, by applying knowledge within the skill of the relevant art(s) (including the contents of the documents cited and incorporated by reference herein), readily modify and/or adapt for various applications such specific embodiments, without undue experimentation, without departing from the general concept of the present invention. Such adaptations and modifications are therefore intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one skilled in the relevant art(s).

While various embodiments of the present invention have been described above, it should be understood that they have been presented by way of example, and not limitation. It would be apparent to one skilled in the relevant art(s) that various changes in form and detail could be made therein without departing from the spirit and scope of the invention. Thus, the present invention should not be limited by any of the above-described exemplary embodiments but should be defined only in accordance with the following claims and their equivalents.

What is claimed is:

1. An article of furniture comprising:

a frame having a first side wall and an opposing second side wall, the first and second side walls having mounting holes formed along inner surfaces thereof;

at least one first electrical connector that is coupled to the first side wall, the at least one first electrical connector having a plurality of conductive sockets that are open along an inner surface of the first side wall of the frame, the at least one first electrical connector being configured for electrification by being connected to a power cable for connection to a power source, the plurality of conductive sockets defining different vertical mounting positions within the frame;

at least one conductive shelf pin that is inserted into one selected conductive socket;

a plurality of shelf mounting pins for insertion into select mounting holes;

at least one shelf that is coupled to the frame in an adjustable manner, each shelf having at least one contact pin assembly along one end of the shelf, each contact pin assembly includes a biased conductive contact pin that protrudes downward from a bottom surface of the shelf and is for placement in intimate contact with one conductive shelf pin; and a lighting system that is associated within that at least one shelf and is conductively connected to the biased conductive contact pin such that the shelf can be freely adjusted within the frame by placing the shelf on at least one conductive shelf pin and select shelf mounting pins such that the biased contact pin makes contact with the at least one conductive shelf pin.

2. The article of claim 1, wherein the article of furniture comprises a bookcase in which the first and second side walls are parallel to one another and are connected together by a bottom wall and a top wall.

3. The article of claim 1, wherein the first electrical connectors comprises a plurality of conductive plates with at least one conductive plate being mounted to the first side wall of the frame, each conductive plate having a plurality of conductive sockets that protrude outwardly through respective holes in the first side wall so as to be open and accessible along the inner surface of the first side wall.

4. The article of claim 3, wherein there are two or more conductive plates mounted to the first side wall, the two or more conductive plates being connected in series by one or more second electrical connector.

5. The article of claim 4, wherein the one or more second electrical connector comprises a conductive wire that is attached at one end to one conductive plate and at an opposite end to another conductive plate so as to electrically connect the two conductive plates to one another.

6. The article of claim 3, wherein the conductive sockets of the conductive plates are arranged longitudinally along the first side wall and are disposed directly opposite the mounting holes formed on the second side wall so as to define groups of at least one conductive socket and a plurality of mounting holes that are contained in different defined horizontal planes that are spaced apart from one another.

7. The article of claim 6, wherein the first side wall includes one first electrical connector at a forward location and one first electrical connector at a rearward location such that two corners of the shelf are supported by conductive shelf pins that are inserted into conductive sockets of the first electrical connectors and the other two corners of the shelf are supported by shelf mounting pins.

8. The article of claim 1, wherein the contact pin assembly is at least substantially contained within a hollow space formed at one end of the shelf with the biased conductive contact pin being supported within a contact pin support that is disposed within the hollow space, the biased conductive pin passing through a hole formed in a bottom wall of the contact pin support so as to be exposed below the bottom surface of the shelf, the bottom wall of the contact pin support partially defining the bottom surface of the shelf.

9. The article of claim 8, wherein the contact pin support includes a top wall connected to the bottom wall with a vertical inner wall, with a spring being disposed against an underside of the top wall at one end and against the biased contact pin at an opposite end of the spring for generating and applying a downward spring force to the biased contact pin.

10. The article of claim 9, wherein a width of the top wall is less than a width of the bottom wall and a finishing edge is mounted to the end of the shelf so as to cover the contact pin assembly and define an end of the shelf.

11. The article of claim 1, wherein the lighting system is conductively connected to the biased contact pin by a wire.

12. The article of claim 1, wherein the lighting system is disposed along the bottom surface of the shelf.

13. The article of claim 1, wherein the at least one first electrical connector comprises a pair of first electrical connectors that are disposed along the outer surfaces of the side walls of the frame.

14. The article of claim 1, wherein the lighting system comprises a string of LEDs.

15. The article of claim 11, wherein the wire is connected to a side of the biased contact pin.

16. The article of claim 1, wherein the at least one conductive shelf pin and the plurality of shelf mounting pins comprise metal pins.

17. The article of claim 1, wherein there are two first electrical connectors that are coupled to the first side wall and spaced apart and located opposite two corners of the shelf.

18. An article of furniture comprising:

a frame having a first side wall and an opposing second side wall, the first and second side walls having mounting holes formed along inner surfaces thereof;

a pair of first electrical connectors that are coupled to the first side wall in spaced relationship, each first electrical connector having a plurality of conductive sockets that pass through one set of the mounting holes and are open along an inner surface of the first side wall of the frame, each first electrical connector being configured for electrification by being connected to a common power cable for connection to a power source, the plurality of conductive sockets along with select mounting holes defining different vertical mounting positions within the frame;

two conductive shelf pins that are inserted into selected conductive sockets of the first electrical connectors and another set of conductive shelf pins for insertion into select mounting holes that along with the two other conductive shelf pins lie within one horizontal plane;

at least one shelf that is coupled to the frame in an adjustable manner, each shelf having a pair of contact pin assemblies along one end of the shelf, each contact pin assembly includes a biased conductive contact pin that protrudes downward from a bottom surface of the shelf and is for placement in intimate contact with one respective conductive shelf pin; and a lighting system that is associated within that at least one shelf and is conductively connected to at least one of the biased conductive contact pins such that the shelf can be freely adjusted within the frame by placing the shelf on at least one conductive shelf pin and select shelf mounting pins.

19. The article of furniture of claim 18, wherein the one contact pin assembly comprises a live contact pin assembly for connection to a positive terminal of a power source and the other contact pin assembly comprises a ground contact pin assembly for connection to a negative terminal of the power source.

* * * * *